United States Patent [19]

Tsui

[11] 4,272,909

[45] Jun. 16, 1981

[54] TOY MEDICAL MONITOR UNIT

[75] Inventor: Kwok W. Tsui, Hong Kong, Hong Kong

[73] Assignee: Arco Industries Ltd., Hong Kong, Hong Kong

[21] Appl. No.: 143,851

[22] Filed: Apr. 25, 1980

[51] Int. Cl.[3] ..... A63H 33/30; A63H 29/16

[52] U.S. Cl. ..... 46/39; 46/44

[58] Field of Search ..... 46/44, 39

[56] References Cited

U.S. PATENT DOCUMENTS

| | | | |
|---|---|---|---|
| 369,404 | 9/1887 | Heston et al. | 46/44 X |
| 1,610,005 | 12/1926 | Haag | 46/39 |
| 3,599,363 | 8/1971 | Baginski et al. | 46/39 |
| 4,174,588 | 11/1979 | Clanton | 46/44 |

*Primary Examiner*—F. Barry Shay

*Attorney, Agent, or Firm*—C. Hercus Just

[57] ABSTRACT

A toy medical monitoring unit having a housing with viewing openings for a plurality of rotatable cylindrical drums respectively having indicia-simulating pulse rate and blood pressure, bellows means operable manually to rotate said drums, a dial indicating fictitious body temperature and a reference needle movable relative to said dial and actuated by a double-acting bellows movable in one direction by blowing upon a mouthpiece on a hose connected to said bellows and the resiliency of the bellows restoring it to initial position after manual compression of the bellows.

7 Claims, 6 Drawing Figures

4
4

TOY MEDICAL MONITOR UNIT

BACKGROUND OF THE INVENTION

Toy medical units are very popular with young children when playing nurse or doctor and particularly to simulate the monitoring of various things, such as pulse rate, blood pressure and temperature. Toys of this type have been developed heretofore either directly pertaining to this type of toy or employing indicia-viewable means and/or compressible bulbs to actuate certain dials or the like. Typical examples of this type of toy are found in prior U.S. Pat. Nos. 2,588,038 to Pagenhardt, dated Mar. 4, 1952, which includes rotatable members with indicia thereon, rotatable by means of air pressure blown into one end of the device; 3,695,148 to Baginski et al, dated Oct. 3, 1972, which shows a toy figure having gripping means actuated in various ways by a plurality of expansible and contractable bellows; and 4,174,588 to Clanton, dated Nov. 20, 1979, which pertains to a toy blood pressure monitoring device operated by a compressible bulb which directs a blast of air against vanes of a rotatable member actuating a finger movable relative to a dial, the latter being associated with an arm band.

The present invention has been developed to be more realistic than the devices of this type which have been developed heretofore, details of which are set forth below:

SUMMARY OF THE INVENTION

It is among the principal objects of the present invention to provide a medical monitoring unit, principally made from plastic material by molding and thereby minimizing the cost to produce components which are readily assembled into a completed unit, which includes a housing having a number of viewing openings therein behind which a plurality of rotatable drums having indicia thereon respectively simulate the monitoring of pulse rate and blood pressure, while an arcuate dial having a rotatable finger simulates body temperature.

It is another object of the invention to actuate the aforementioned drums by automatically expansible bellows members which are manually operated to be compressed to direct air pressure against pistons and cylinders mounted within the housing, said pistons actuating cam means to rotate said drums and, in addition, preferably lock said drums in a recording position where the indicia thereon are accurately aligned with the viewing openings.

One further object of the invention is to operate said temperature indicating dial and finger by means of another bellows similar to those referred to above and operated by means of a tube connected to one end thereof and a mouthpiece on the outer end of the tube serving to have human breath blown into the bellows to expand the same and thereby move the needle relative to the dial in one direction, while automatic retraction of the bellows to the initial position retracts the needle to starting position.

Other objects of the invention comprise the formation of various types of supporting means on a plastic base molded from rigid plastic material and having suitable guide means, open-ended bearings and the like, as well as means to cover said bearings for purposes of supporting opposite ends of said drums having cylindrical supporting bosses on opposite ends thereof received in said bearings, as well as slidable means operating the finger of said temperature recording dial, the bellows for simulating pulse rate and blood pressure also being mounted on one end of tubes which are detachably connected to the housing by means of plugs and sockets and thereby simulate corresponding equipment of professional type to further increase the pleasure and enjoyment of a child, as well as even presenting certain simple educational features pertaining to the operation of medical equipment of a play type.

Details of the foregoing objects and of the invention, as well as other objects thereof are set forth in the following specification and illustrated in the accompanying drawings comprising a part thereof.

DETAILED DESCRIPTION OF THE PREFERRED EMBODIMENT

Figure 1:
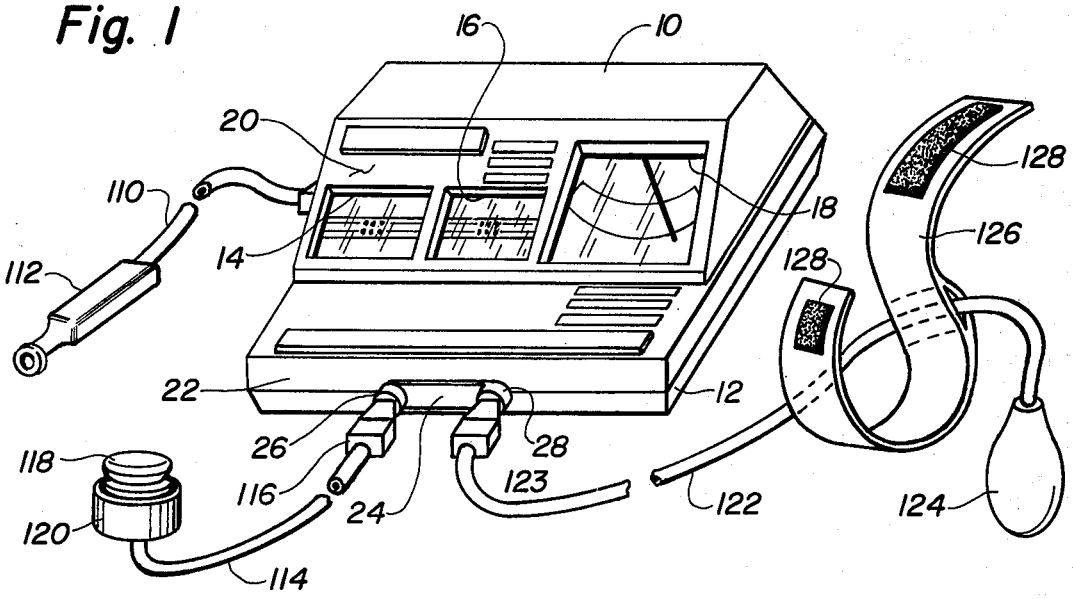
FIG. 1 is a perspective view of a toy medical monitoring unit embodying the principles of the present invention and having connected thereto a plurality of different air-activating means operable to effect visual recording members pertaining to certain physical conditions.
Figure 2:
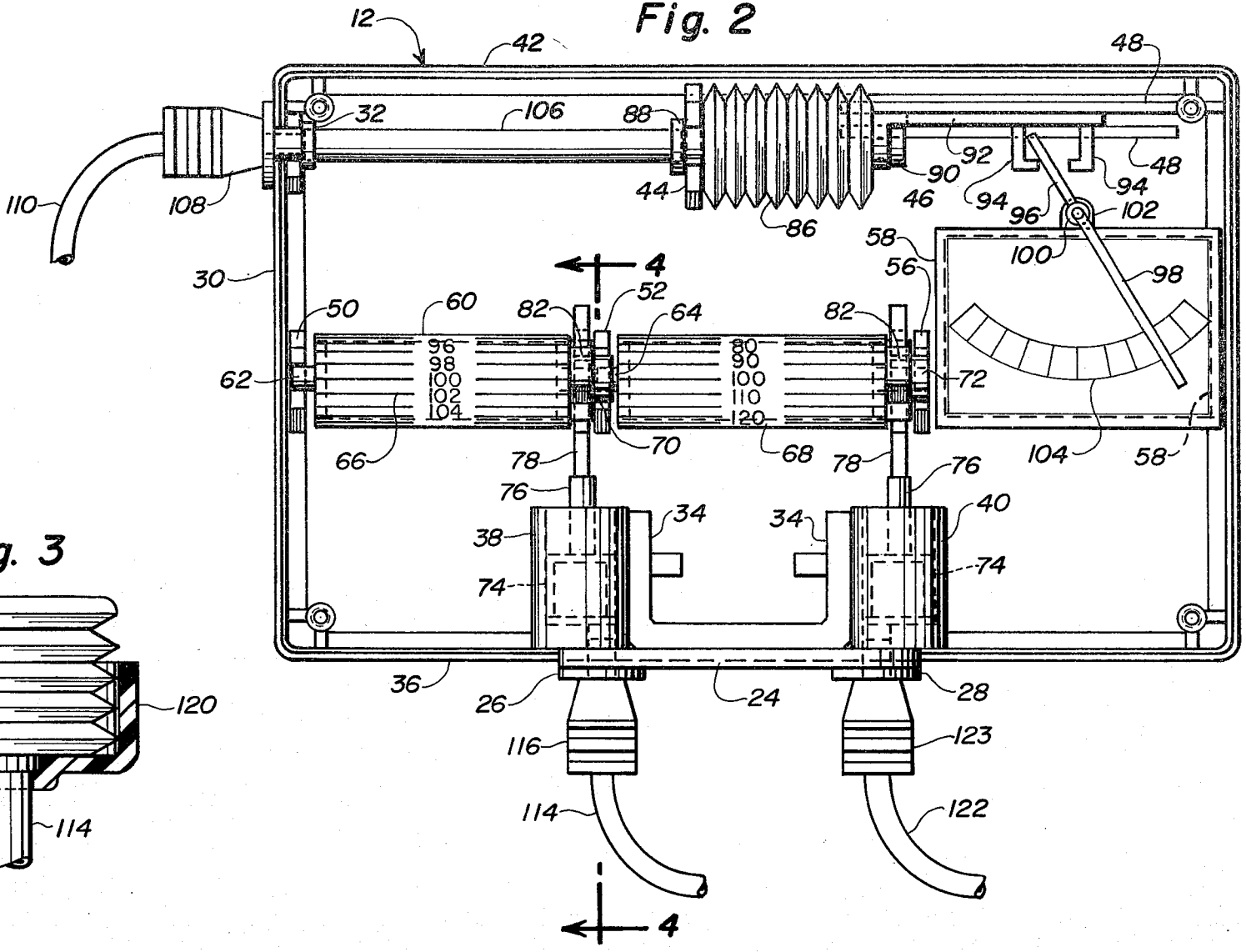
FIG. 2 is a top plan view of the unit shown in FIG. 1 with the top portion of the housing removed and illustrated on a larger scale than employed in FIG. 1.

Referring to FIG. 1, the console of the toy medical monitor unit comprising the present invention is composed of a top housing 10, preferably molded from rigid synthetic resin or plastic material of suitable nature and detachably mounted upon a lower base member 12, which is formed from similar material. The top housing 10 has a pair of similar openings 14 and 16, which are illustrated as being substantially rectangular and in side-by-side relationship and a further opening 18 of larger size and substantially rectangular is disposed on the right-hand side of the housing 10, all of the openings referred to being displayed on a sloping wall 20 of the housing. Also, the lower forward edge of the housing 10 and base 12 comprises a sectional front wall 22, which is substantially vertical and the cooperating portions thereof respectively have elongated notches therein through which a hose coupling panel 24 extends, the same being provided with a pair of tubular coupling members 26 and 28. Referring to FIG. 2, the left-hand side 30 of base 12 has still another tubular coupling member 32 extending therethrough.

The base member 12, as indicated above, is formed by molding the same from suitable relatively rigid plastic material and the same is provided with a plurality of upstanding mounting and positioning members which are formed integrally with the bottom panel of the base member 12. As shown in FIG. 2, there is a pair of parallel elongated positioning ribs 34 adjacent the front edge 36 of the base for purposes of being disposed between a pair of cylinders 38 and 40 which are transversely spaced but are parallel to each other and are connected at the forward ends thereof by the hose coupling panel 24. Slightly spaced from the rear edge 42 of base member 12 is a pair of upstanding ribs 44 and 46 which have notches in the upper ends thereof and another pair of parallel upstanding ribs 48 extend laterally from the ribs 46.

Figure 6:
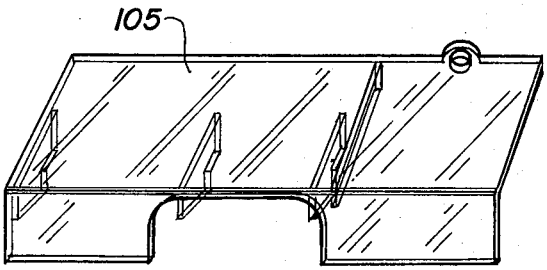
FIG. 6 is an exemplary interior transparent cover which overlies the elements shown in FIG. 2 below the top housing to retain said elements in operative position upon the supports therefor.

Midway between the front and rear edges of base member 12 and extending in longitudinal alignment are further upstanding supporting and positioning ribs 50, 52, and 56, all of which have semi-circular notches in the upper ends thereof. Lastly, adjacent the right-hand edge of FIG. 2, the base member 12 has still another parallel pair of larger upstanding ribs 58. To maintain the movable members upon the upstanding ribs, the invention preferably employs an interior intermediate transparent cover 105, as shown in FIG. 6, which has complementary ribs and the like which overlie the various upstanding ribs 44, and 48–58 and the like, which will maintain the various movable and fixed elements supported thereby accurately in the operative positions thereof. The interior cover 105 is secured by screws applied to certain of the circular studs on base member 12, shown in the corners of the same in FIG. 2.

Referring to FIG. 1, the opening 14 visibly displays a simulated pulse rate-indicating cylinder 60, shown in plan view in FIG. 2. The opposite ends of the cylinder 60 have short bearing shafts 62 and 64, respectively on opposite ends thereof, which are cylindrical and rotatably disposed in the bearing notches or recesses in the upper ends of the upstanding ribs 50 and 52. The cylinder 60 also has parallel lines 66 printed or otherwise formed thereon, and corresponding to imitation pulse rate indicia.

The opening 16 in the top housing 10 visibly displays a second cylinder 68, best shown in FIG. 2 in plan view, which is intended to simulate indicia or other indications comprising blood pressure indicating means and the opposite ends of the cylinder 68 also have short cylindrical bearing shafts 70 and 72, the shaft 70 preferably being of smaller diameter than the shaft 62 of cylinder 60 and being coaxial therewith and received within a socket in the bearing shaft 62 for compact arrangement of the cylinders 60 and 68. Shaft 72 engages upstanding rib 56.

Referring to FIG. 2, the cylinders 38 and 40 are supported stationarily upon the base member 12 and each of them have similar pistons 74 slidably mounted therein and provided with coaxial inwardly extending piston rods 76. Projecting farther inward from the ends of the piston rods 76 are hook-like cam members 78, including V-shaped cam ends 80, which coact with the teeth-like vanes of ratchet gears 82 fixed to one end of the drums.

Figure 4:
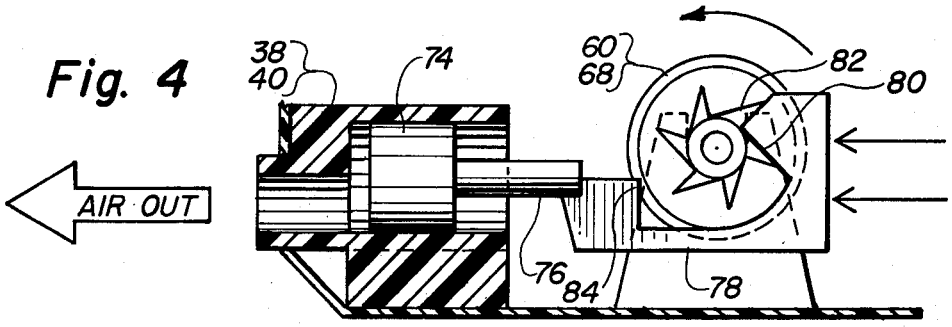
FIG. 4 is diagrammatic side elevation showing one step in the operation of the visual recording devices.
Figure 5:
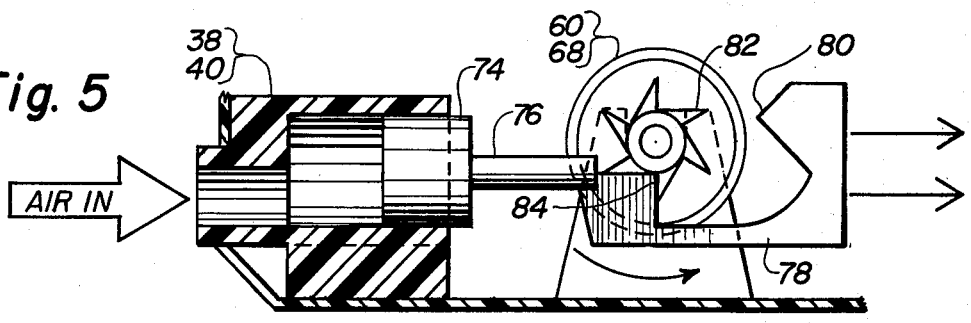
FIG. 5 is a view similar to FIG. 4 but showing the device in a second step following the operation of the movement illustrated in FIG. 4.

Referring to FIG. 5, it will be seen that as air is forced into the cylinders 38 and 40 against pistons 74, it will project a shoulder 84 against one of the teeth on the ratchet gear 82 to rotate the cylinder 60 or 68 counterclockwise, as shown by the arrows, for a partial revolution. Next, when air is exhausted from the cylinders 38 and 40, the piston will move to the left as viewed in FIG. 4, and thereby cause the cam end 80 to engage another tooth of the ratchet gear 82 and advance the same with its cylinder a slight additional distance in counterclockwise direction and such movement terminates, as viewed in FIG. 4, by the cam end 80 resting between two of said teeth and locking the same in said position.

Referring to FIG. 2, a self-reacting accordian-like bellows 86 has a neck and head 88 seated within the notch in upstanding rib 44 to anchor the same against longitudinal movement. The opposite end of said bellows has another neck and head 90 thereon disposed within the notch in rib 46, which is not stationary with respect to the base 12 and is movable with the head 90 of bellows 86 in an axial movement toward and from the stationary upstanding rib 44, when air is delivered to and removed from the bellows 86. The movable rib 46 extends laterally from a longitudinal slide 92, which is guided for movement slidably between the pair of upstanding ribs 48 and the opposite end of the slide 92 has a pair of L-shaped ribs 94 facing each other and between which one end 96 of an indicating needle 98 is disposed for rotatable movement of the needle about a central shaft 100 mounted in a cylindrical bearing 102, upstanding from and integral with base member 12, The pair of upstanding ribs 58 support therebetween an arcuate indicating gauge 104 having radially extending gradients thereon and temperature-indicating indicia, clearly shown in FIG. 2.

The bellows 86 is connected by a hose 106 to tubular coupling socket 32 which receives a plug 108 connected to one end of another tube 110 having a mouthpiece 112 on the opposite end thereof by which a child may blow air into the tube 110 and ultimately the bellows 86 to move the slide 92 to the right and actuate the needle 98 clockwise relative to the temperature-indicating indicia in make-believe manner to record temperature. When the blowing into the mouthpiece 112 ceases, the self-restoring nature of the bellows 86 will retract the slide 92 to the left as viewed in FIG. 2 and move the needle 98 to starting position.

Figure 3:
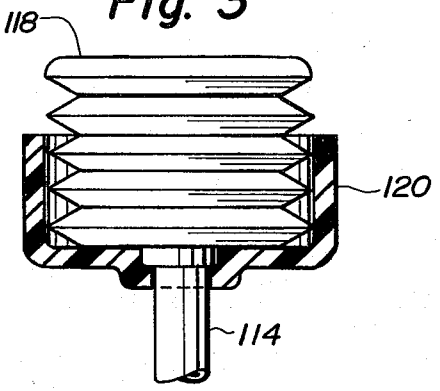
FIG. 3 is a fragmentary longitudinal sectional view of one of the bellows devices mounted on one of the hoses shown in FIG. 1.

The pulse rate-indicating cylinder 60 is operated by an air hose 114 by means of a plug 116 on one end thereof which is received within the tubular coupling plug member 26 to communicate air to the cylinder 38 by means of a relatively short bellows 118, as seen in FIG. 3, which is formed of material similar to the bellows 86 and is also accordian-like and partially enclosed within a rigid cup-shaped member 120, which is connected to the outer end of hose 114. In operation, when the bellows 118 and cup-shaped member 120 are applied against the wrist of a child and the cup member 120 is moved toward and from said wrist, pulsation of the bellows 118 will occur to generate successively air pressure and suction within the cylinder 38 and correspondingly actuate the drum 60 to result in play-like indication of a pulse rate by the parallel line 66, for example.

Another hose 122, shown best in FIG. 1, is connected at one end to another plug 123, insertable into the tubular coupling plug 28 and the opposite end thereof is connected to a collapsible and expandable bulb 124, which, if desired, may have a bellows and cup assembly 118 and 120, such as shown in FIG. 3, substituted therefor. The hose 122 also is fastened to a simulated arm band 126 which a child may wrap around the arm of another and fasten the same thereto by securing means, such as patches of Velcro 128, and thereby imitate the blood pressure arm band normally used by physicians, but in imitation manner.

As far as convenient and readily possible, all of the components described hereinabove are formed from suitable plastic material. Where the part is preferably rigid, an appropriate rigid type of plastic is selected and, as in the case of the tubes 110, 114 and 122, a flexible type of plastic is selected, or rubber tubes may be used, if desired. Suitable clearance also is provided between relatively movable parts so as to minimize, if not preclude, the possibility of binding occurring between the parts. Particularly from FIG. 1, it will be seen that a relatively realistic type of medical monitor unit is provided with a plurality of different air-operated indicating means respectively for simulating pulse rate, blood pressure and temperature, thereby affording substantial amusement to children playing with the same and the structure is of a rugged and durable nature and readily capable of being played with, as well as shipped, without injury, as long as reasonable care is maintained.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy medical monitor unit to simulate registering respectively on gages pulse rate, blood pressure and body temperature, said unit comprising in combination, a housing having a base and viewing openings therein, a plurality of automatically expandable and contractable bellows mounted to said unit, a plurality of cylindrical drums supported within said housing adjacent said viewing openings, indicia respectively on said drums simulating reading of pulse rate and blood pressure, a plurality of cylinder and piston units within said housing respectively adjacent said drums, tube means connecting one end of each bellows with one end of a respective cylinder and operable to reciprocate said pistons in said cylinders in opposite directions respectively by means of air pressure and suction induced by manual compression and automatic expansion of said bellows, means connected to said pistons and operable to move said drums to display certain fictitious pulse rate and blood pressure indicating indicia on said drums respectively in said viewing openings, an arcuate scale in said housing viewable through another one of said plurality of viewing openings, a dial finger rotatably supported for movement of said finger relative to said scale to simulate body temperature, another bellows similar to said aforementioned bellows mounted within said housing adjacent said scale and havng one end anchored relative to said base of said housing, a reciprocable member fixed to one end of said other bellows and engageable with said dial finger to rotate it relative to said scale, and a tube having one end connected to said other bellows and the other end having a mouthpiece operable to be blown by a child to expand said other bellows to produce movement of said dial finger in one direction and release of said pressure automatically permitting said other bellows to retract and restore said dial finger to initial position relative to said scale.

2. The toy unit according to claim 1 wherein said housing and base are formed from molded rigid plastic material, said base having a bottom upon which open-ended bearing members extend upwardly therefrom, said drums also being molded from rigid plastic material and having closed ends supporting cylindrical bosses rotatably supported in said open-ended bearing members, and transparent means overlying said drums and having means thereon engaging said open-ended bearing members to close the same and maintain said bosses therein.

3. The toy unit according to claim 1 in which said bellows are molded from self-restoring elastic plastic material and are cylindrically accordion in shape, one end thereof being closed and the other having an opening to receive one end of a tube and said closed end being adapted to be pressed manually toward the other end to produce air pressure and the resilient nature of the plastic material being operable to restore the bellows to initial expanded shape to produce suction within said tubes and the cylinders connected thereto to operate said means to move said drums.

4. The toy unit according to claim 3 in which said another bellows has a connecting member on the closed end thereof and said reciprocable member is a plate-like member having means to receive said connecting member for firm connection therewith, means on said base slidably supporting said plate-like member and the latter having means to receive a prong on said dial finger for operable connection to said plate-like member and said base having a bearing socket for a shaft on said dial finger to rotatably support the same.

5. The toy unit according to claim 3 in which said housing has sockets thereon respectively to receive plugs connected to said tubes connected to said plurality of bellows on the ends leading to said cylinders, means fixedly supporting said cylinders within said housing and said plugs being disconnectible to said sockets, said sockets communicating with said cylinders, and said means connected to said pistons to move said drums comprising cam members reciprocably supported by said base and said drums having ratchet gears on one end thereof in alignment with said reciprocable cam members and operable in one direction to rotate said drums in one direction to effect display of indicia on said drums in said viewing openings in said housing.

6. The toy unit according to claim 5 in which each of said cam means has two operative members thereon engageable with the associated ratchet gear, one of said members being engageable with said associated ratchet gear when the associated bellows is compressed to cause air pressure to move its associated piston and cam means in one advancing direction to move its associated drums in one direction for a segment of rotation and said other cam member being operable to engage another segment of said associated ratchet gear when said associated piston is moved in the opposite direction by suction caused by expansion of said associated bellows and thereby effect further segmental movement of said associated drum in said direction to complete a predetermined segment of movement thereof to align an indicia thereon with a viewing opening in said housing.

7. The toy unit according to claim 6 in which said other cam member is shaped to be received between a pair of teeth on said associated ratchet gear at the completion of the segmental movement of said drum associated thereby and lock said associated drum in said completed rotational movement thereof and maintain the same in said position until said associated bellows is again compressed.

* * * * *